US009982487B2

(12) United States Patent
Samuel et al.

(10) Patent No.: US 9,982,487 B2
(45) Date of Patent: May 29, 2018

(54) WELLBORE DRILLING SYSTEMS WITH VIBRATION SUBS

(71) Applicant: Halliburton Energy Services, Inc., Houston, TX (US)

(72) Inventors: Robello Samuel, Cypress, TX (US); Douglas B. Caraway, Conroe, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 387 days.

(21) Appl. No.: 14/810,054

(22) Filed: Jul. 27, 2015

(65) Prior Publication Data

US 2016/0053546 A1 Feb. 25, 2016

Related U.S. Application Data

(60) Provisional application No. 62/041,547, filed on Aug. 25, 2014.

(51) Int. Cl.
*E21B 7/24* (2006.01)
*E21B 28/00* (2006.01)

(52) U.S. Cl.
CPC ..... *E21B 7/24* (2013.01); *E21B 28/00* (2013.01)

(58) Field of Classification Search
CPC ..... E21B 7/24
See application file for complete search history.

(56) References Cited

U.S. PATENT DOCUMENTS

| | | | | |
|---|---|---|---|---|
| 2,911,192 | A * | 11/1959 | Boucher | E21B 7/24 175/105 |
| 3,285,349 | A * | 11/1966 | Brandon | E21B 7/064 175/319 |
| 3,633,688 | A * | 1/1972 | Bodine | E21B 7/24 173/49 |
| 4,243,112 | A * | 1/1981 | Sartor | E21B 4/02 175/107 |
| 4,518,888 | A | 5/1985 | Zabcik | |
| 5,115,880 | A | 5/1992 | Sallas et al. | |
| 6,279,670 | B1 | 8/2001 | Eddison et al. | |
| 6,508,317 | B2 | 1/2003 | Eddison et al. | |
| 6,998,999 | B2 | 2/2006 | Fripp et al. | |
| 8,033,328 | B2 | 10/2011 | Hall et al. | |
| 8,517,093 | B1 * | 8/2013 | Benson | E21B 1/00 166/177.1 |
| 8,534,380 | B2 | 9/2013 | Sheppard et al. | |
| 8,714,005 | B2 | 5/2014 | Vetter | |
| 2006/0157280 | A1 * | 7/2006 | Fincher | E21B 7/24 175/57 |
| 2006/0191682 | A1 * | 8/2006 | Storm | E21B 47/011 166/250.01 |
| 2010/0000793 | A1 | 1/2010 | White | |

(Continued)

FOREIGN PATENT DOCUMENTS

CA 2348554 A1 11/2001

*Primary Examiner* — Shane Bomar
(74) *Attorney, Agent, or Firm* — McDermott Will & Emery LLP

(57) ABSTRACT

A bottom-hole assembly includes a drill string extendable within a wellbore and a drill bit positioned at a distal end of the drill string. A vibration sub is positioned in the drill string axially adjacent the drill bit and includes one or more vibratory devices that impart vibration to the drill bit.

15 Claims, 8 Drawing Sheets

(56) References Cited

U.S. PATENT DOCUMENTS

| | | | | |
|---|---|---|---|---|
| 2010/0089647 | A1* | 4/2010 | Forster | E21B 7/24 175/57 |
| 2010/0319994 | A1* | 12/2010 | Wiercigroch | E21B 7/24 175/56 |
| 2013/0200756 | A1 | 8/2013 | Maki, Jr. | |
| 2013/0340999 | A1* | 12/2013 | Benson | E21B 1/00 166/66 |
| 2016/0017662 | A1* | 1/2016 | Orel | E21B 7/24 175/57 |
| 2017/0335631 | A1* | 11/2017 | Eddison | E21B 10/322 |

* cited by examiner

WELLBORE DRILLING SYSTEMS WITH VIBRATION SUBS

BACKGROUND

Wellbores are formed in subterranean formations for various purposes including, for example, the extraction of oil and gas and the extraction of geothermal heat. Such wellbores are typically formed using one or more drill bits, such as fixed-cutter bits (sometimes referred to in the art as polycrystalline diamond compact or PDC bits), rolling-cutter bits (sometimes referred to in the art as "rock" bits), diamond-impregnated bits, and hybrid bits, which may include, for example, both fixed cutters and rolling cutters. The drill bit is coupled either directly or indirectly to an end of a drill string or work string, which encompasses a series of elongated tubular segments connected end-to-end that extends into the wellbore from the surface. Drilling is a process of forming the wellbore by rotating the drill bit so that its cutters or abrasive structures cut, crush, shear, and/or abrade away the formation materials.

To enlarge the diameter of the wellbore, a "reamer" (also referred to as a "hole opening device" or a "hole opener") may be used in conjunction with the drill bit as part of a bottom-hole assembly (BHA). The reamer is typically axially-offset and uphole from the drill bit along the length of the BHA. In operation, the drill bit operates as a pilot bit to form a pilot bore in the subterranean formation, and the reamer follows the drill bit through the pilot bore to enlarge the diameter of the wellbore as the BHA advances into the formation.

Various non-ideal drill string behaviors can occur while drilling due to the complex dynamic behavior of the drill string and its interaction with the formation being drilled. One such mode of undesirable drill string behavior is known as stick-slip. During drilling, the drill string can be elastically twisted (i.e. torsionally flexed without appreciable yielding), up to several full 360-degree revolutions, while the drill bit temporarily sticks due to friction between the drill bit and the formation. Torsion in the drill string builds to an excessive value that eventually frees the drill bit, causing the freed drill bit to rotate violently with an angular velocity that is temporarily much higher than the angular velocity measured at the surface. Stick-slip causes excessive and unwanted vibrations for a drill string in the torsional direction, along with excessive drill bit speeds, which can lead to premature bit wear or failure of the drill bit or other drill string components.

Another mode of undesirable drill string behavior is known as "bit whirl." During drilling, the intended rotational motion of the drill string is around its own central axis. Bit whirl is an additional bulk rotation of the drill string, which is eccentric or precessing rotation of the drill string offset from the wellbore axis. This additional bulk rotation can be induced due to bending forces on the drill string in combination with the spinning rotation of the drill string about its own axis. Whirling motion can occur in the same direction as the rotation of the drill string (forward whirl) or in the opposite direction (backward whirl). Backward whirl is known to be a particularly strong cause of PDC (polycrystalline diamond compact) drill bit failures and of lower performance of PDC drill bits.

Efforts to reduce or eliminate unwanted drill string behavior such as stick-slip and bit whirl include modeling drill string behavior to identify causes and solutions.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Figure 1:
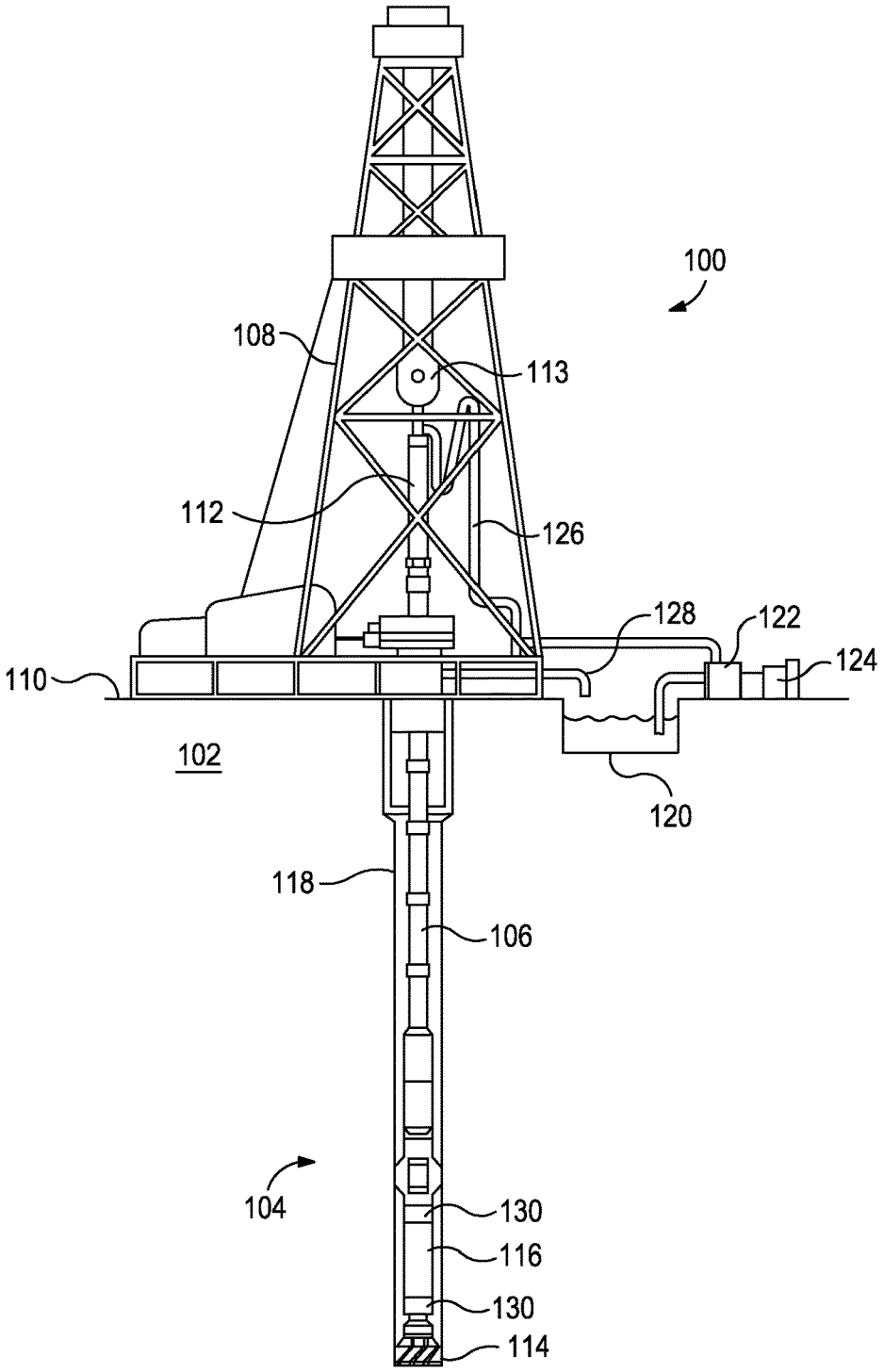
FIG. 1 depicts a drilling system that can employ the principles of the present disclosure

The present disclosure is related to wellbore operations and, more particularly, to minimizing stick-slip and backward whirl in drilling wellbores using one or more vibration subs positioned in a drill string.

According to embodiments of the present disclosure, one or more vibration subs may be included in a bottom-hole assembly (BHA) to mitigate stick-slip and backward whirl of drill strings and associated drill bits. More particularly, the vibration subs may employ one or more vibration-inducing actuators or elements, generally referred to herein as "vibratory devices," such as a piezoceramic actuator, that introduce "chattering" or vibrations of a very small displacement, but at high frequency, to a BHA. Suitable frequencies for operating the piezoceramic actuators may be in the range of several to several-hundred kilohertz. For example, vibratory devices such as piezoceramic actuators may be operated with a range of vibrational frequencies including, but not limited to, between 1 hertz (Hz) and 100 Hz, between 100 Hz and 1000 Hz, between 0.001 Hz and 500 Hz, or between 100 Hz and 500 Hz. Applying vibrations to a BHA and an associated drill bit at such frequencies may result in the drill bit continuously chattering (i.e., vibrating) such that the "stick" phase of the stick-slip phenomenon is mitigated or otherwise entirely prevented from occurring.

In various embodiments, the vibrational orientation and frequency generated by the vibration subs can be tuned to mitigate or eliminate the effects of stick-slip, backward whirl, and/or bit bounce during drilling and/or non-drilling operations. The vibration subs may be operated continuously during drilling operations or may be activated when measurements (e.g., local vibrations that exceed a predetermined threshold) indicate that phenomena such as stick-slip, backward whirl, and/or bit bounce are occurring or are about to occur. It should be noted that the low-magnitude and high frequency chattering provided by the piezoceramic actuators does no harm to the drill bit or the drill string since the resulting induced strain is very small.

Vibrations may be induced at one or more vibrational frequencies that are specific to reducing the effects of a particular unwanted phenomenon. As examples, vibrations may be induced at vibrational frequencies between 1 Hz and 10 Hz to reduce or counteract bit bounce, between 3 Hz and 50 Hz to reduce or counteract bit whirl, between 5 Hz and 20 Hz to reduce or counteract BHA whirl, between 0.001 Hz and 5 Hz to reduce or counteract stick-slip, between 50 Hz and 250 Hz to reduce or counteract torsional resistance, between 50 Hz and 250 Hz to reduce or counteract bit chatter, or between 1 Hz and 50 Hz to reduce or counteract modal coupling between lateral, axial, and/or torsional motions in the drill string. In some scenarios, vibrations may be induced at vibrational frequencies is more than one of the above exemplary frequency ranges to reduce or counteract multiple unwanted motions in the drill string.

If the tendency of stiction for a particular application is high, or stiction is already in process for the particular application, the vibration-inducing actuators can be modified to operate in the ultrasonic range, thereby transforming the BHA or drilling system into an ultrasonic drilling machine. As operating in the ultrasonic range, the drilling system may break the rock and further prevent stick-slip from happening, or break any occurring stiction.

Referring to FIG. 1, illustrated is an exemplary drilling system 100 that may employ one or more principles of the present disclosure. Boreholes may be created by drilling into the earth 102 using the drilling system 100. The drilling system 100 may be configured to drive a bottom-hole assembly (BHA) 104 positioned or otherwise arranged at the bottom of a drill string 106 extended into the earth 102 from a derrick 108 arranged at the surface 110. The derrick 108 includes a kelly 112 and a traveling block 113 used to lower and raise the kelly 112 and the drill string 106.

The BHA 104 may include a drill bit 114 operatively coupled to a tool string 116 which may be moved axially within a drilled wellbore 118 as attached to the drill string 106. During operation, the drill bit 114 penetrates the earth 102 and thereby creates the wellbore 118. The BHA 104 provides directional control of the drill bit 114 as it advances into the earth 102. The tool string 116 can be semi-permanently mounted with various measurement tools (not shown) such as, but not limited to, measurement-while-drilling (MWD) and logging-while-drilling (LWD) tools, that may be configured to take downhole measurements of drilling conditions. In other embodiments, the measurement tools may be self-contained within the tool string 116, as shown in FIG. 1.

Fluid or "mud" from a mud tank 120 may be pumped downhole using a mud pump 122 powered by an adjacent power source, such as a prime mover or motor 124. The mud may be pumped from the mud tank 120, through a stand pipe 126, which feeds the mud into the drill string 106 and conveys the same to the drill bit 114. The mud exits one or more nozzles arranged in the drill bit 114 and in the process cools the drill bit 114. After exiting the drill bit 114, the mud circulates back to the surface 110 via the annulus defined between the wellbore 118 and the drill string 106, and in the process, returns drill cuttings and debris to the surface. The cuttings and mud mixture are passed through a flow line 128 and are processed such that a cleaned mud is returned down hole through the stand pipe 126 once again.

Although the drilling system 100 is shown and described with respect to a rotary drill system in FIG. 1, those skilled in the art will readily appreciate that many types of drilling systems can be employed in carrying out embodiments of the disclosure. For instance, drills and drill rigs used in embodiments of the disclosure may be used onshore (as depicted in FIG. 1) or offshore (not shown). Offshore oil rigs that may be used in accordance with embodiments of the disclosure include, for example, floaters, fixed platforms, gravity-based structures, drill ships, semi-submersible platforms, jack-up drilling rigs, tension-leg platforms, and the like. It will be appreciated that embodiments of the disclosure can be applied to rigs ranging anywhere from small in size and portable, to bulky and permanent.

Further, although described herein with respect to oil drilling, various embodiments of the disclosure may be used in many other applications. For example, disclosed methods can be used in drilling for mineral exploration, environmental investigation, natural gas extraction, underground installation, mining operations, water wells, geothermal wells, and the like. Further, embodiments of the disclosure may be used in weight-on-packers assemblies, in running liner hangers, in running completion strings, etc., without departing from the scope of the disclosure.

As shown in FIG. 1, BHA 104 may include one or more vibration subs 130 (two shown) configured to impart vibration to various portions of the drill string 106, such as the BHA 104. As described herein, in various embodiments, the vibration sub(s) 130 may be located in the BHA 104 at a variety of locations, such as adjacent to the drill bit 114 or adjacent to other components of the BHA 104, such as a stabilizer or a reamer. Vibratory devices or actuators may also, or alternatively, be positioned on or within other components of the BHA such as on or within a stabilizer, on or within a rotary steerable system (RSS) component, or on or within a reamer. Further details of the various implementations of the vibration sub(s) 130 and other vibratory devices of the BHA 104 are described hereinafter.

Figure 2:
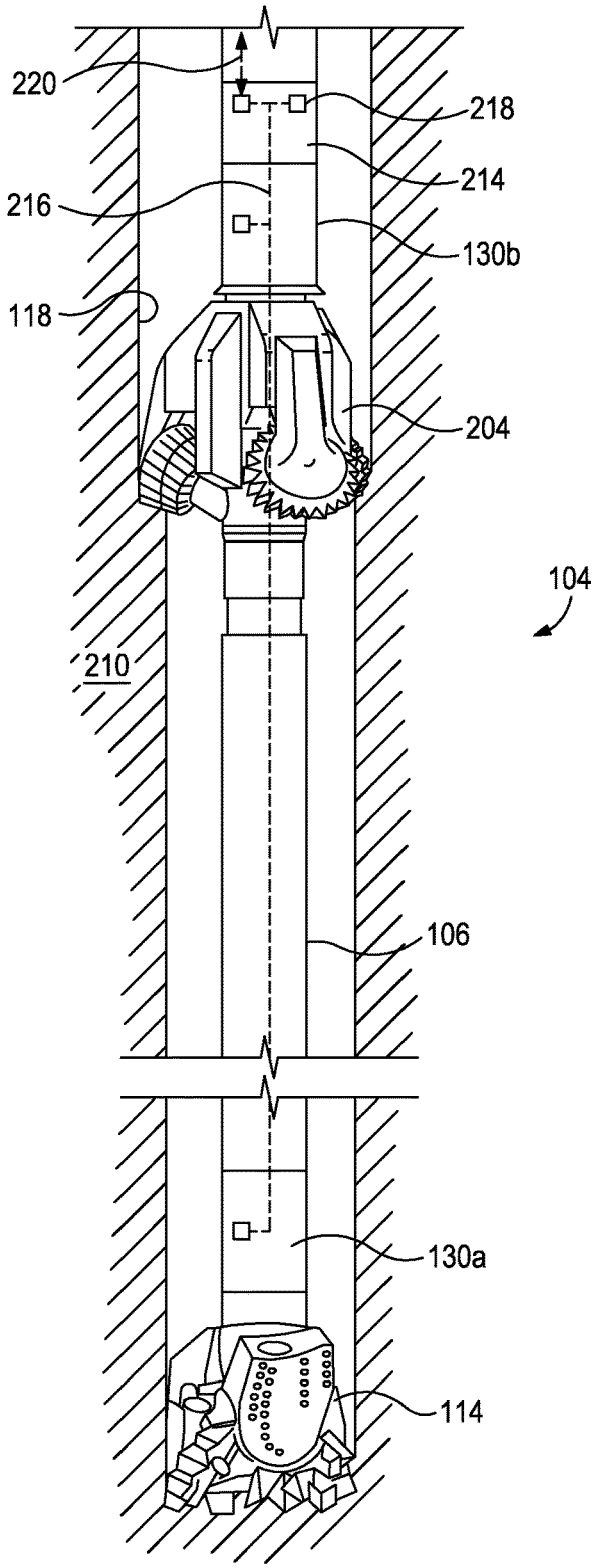
FIG. 2 is an elevational view of an exemplary bottom-hole assembly lowered into a representative wellbore.

FIG. 2 is an enlarged, elevational view of the BHA 104 as lowered into the wellbore 118. As illustrated, the BHA 104 includes the drill bit 114 and may further include a reamer 204 that is axially spaced along the drill string 106 that extends from the surface 110 (FIG. 1). The drill bit 114 and the reamer 204 may be configured to drill the wellbore 118 through into a surrounding subterranean formation 210 for the purposes of extracting hydrocarbons therefrom. As the drill string 106 advances the BHA 104 into the subterranean formation 210, the drill bit 114 may form the wellbore 118 at a first diameter, and the reamer 204 may follow behind the drill bit 114 to expand the size of the wellbore 118 to a second diameter, where the second diameter is greater than the first diameter. The drill bit 114 may be rotated within the wellbore by, for example, by rotating the drill string 106 from the surface. In other embodiments, however, a downhole motor or mud pump (not shown) may alternatively be used to rotate the drill bit 114, without departing from the scope of the disclosure.

While not specifically illustrated, those skilled in the art will readily appreciate that the BHA 104 may further include various other types of drilling tools or components such as, but not limited to, a steering unit, one or more stabilizers, one or more mechanics and dynamics tools, one or more drill collars, one or more jars or jarring tools, one or more accelerators, and one or more heavy weight drill pipe segments.

As illustrated, the BHA 104 may further include a first vibration sub 130*a* and a second vibration sub 130*b* coupled to or otherwise forming part of the drill string 106. The first vibration sub 130*a* may be arranged adjacent or otherwise proximate to the drill bit 114, and the second vibration sub

130*b* may be arranged adjacent or otherwise proximate to the reamer 204. As illustrated, the first vibration sub 130*a* is positioned above the drill bit 114, and the second vibration sub 130*b* is positioned above a reamer 204 included in the BHA. The first and second vibration subs 130*a,b* may prove useful and otherwise advantageous in preventing stick-slip for each of the drill bit 114 and the reamer 204, respectively. In some embodiments, however, only one of the first or second vibration subs 130*a,b* may be employed, without departing from the scope of the disclosure.

The first and second vibration subs 130*a,b* may be configured to impart at least one of lateral, axial, circumferential, torsional, and longitudinal vibrations to the BHA 104 and, therefore, to the drill bit 114 and/or the reamer 204. For instance, the first vibration sub 130*a* may be configured to generate vibrations to be imparted to the drill bit 114 to prevent and/or counteract sticking of the drill bit, whirl effects, and/or bit bounce. Similarly, the second vibration sub 130*b* may be configured to generate vibrations to be imparted to the reamer 204 to prevent and/or counteract sticking of the reamer, whirl effects, and/or other unwanted displacement or vibration of the reamer and other portions of the drill string. In other embodiments, however, a single one of the first or second vibration subs 130*a,b* may be included in the BHA 104 and used to generate vibrations that can be received by both the drill bit 114 and the reamer 204 to prevent and/or counteract sticking, whirl effects, and/or other unwanted displacement or vibration in the drill bit 114 and the reamer 204.

In some embodiments, sensing and/or power components for powering and controlling vibratory devices or actuators may be included in one or both of the vibration subs 130*a,b*. In some embodiments, for instance, one or more sensor subs (not shown) may be included in the BHA 104 and used to monitor real-time downhole conditions. One suitable sensor sub includes the DRILLDOC® tool commercially-available from Sperry Drilling of Houston, Tex., USA. The DRILLDOC® tool, or a similar type of sensor sub, may provide real-time measurements of weight, torque and bending on the adjacent cutting tool (i.e., drill bit 114 and reamer 204) to characterize the transfer of energy from the surface 110 (FIG. 1) to the cutting tool. Operation of one or both of the vibration subs 130*a,b* may be adjusted and otherwise regulated based on measurements gathered by a sensor sub at a corresponding location near the drill bit 114 and/or reamer 204. Moreover, the location, orientation, number, and vibrational characteristics (e.g., potential vibrational amplitudes and frequencies) of the vibration subs 130*a,b* may be determined based on the configuration of the drill string 106 and, more particularly, based on the type of drill bit 114 and reamer 204.

The BHA 104 may further include a bi-directional communications module 214 coupled to or otherwise forming part of the drill string 106. The communications module 214 may be communicably coupled to each of the first and second vibration subs 130*a,b* via one or more communication lines 216 such that the communications module 214 may be configured to send and receive data and/or control signals to/from the first and second vibration subs 130*a,b* in real time. Accordingly, the communications module 214 may be provided with real time operational parameters of both the drill bit 114 and the reamer 204 during drilling operations.

In some embodiments, the communications module 214 may include one or more microprocessors 218, such as a closed feedback enabling microprocessor, or the like. The microprocessor 218 may be configured to receive measurements from a sensor sub and/or operate the first and second vibration subs 130*a,b*. As a result, the first vibration sub 130*a* may be operated responsive to the general or specific operating conditions of the drill bit 114 in real time, and the second vibration sub 130*b* may likewise be operated responsive to the general or specific operating conditions of the reamer 204 in real time.

The communications module 214 may further be communicably coupled to the surface 110 (FIG. 1) via one or more communication lines 220 such that the communications module 214 may be able to send and receive data in real time to/from the surface 110 during operation. For instance, the communications module 214 may be configured to communicate to the surface various downhole operational parameter data as acquired via sensor subs. Once received at the surface 110, an operator may consider the monitored and reported operational parameter data and, if necessary, undertake one or more corrective actions or the like in response. For example, the operator may initiate operation of one or more of the vibration subs 130*a,b* in response to the received data. In some embodiments, one corrective action may include sending one or more command signals or corrective action signals downhole to the communications module 214 to initiate actuation of one or both of the vibration subs 130*a* and/or 130*b*.

In other embodiments, however, the communications module 214 may communicate with a computerized system (not shown) or the like configured to receive the various downhole operational parameter data as acquired by the sensor subs and to control the vibration subs 130*a,b* independently of acquired sensor data or based on the sensor data. As will be appreciated, such a computerized system may be arranged either downhole (i.e., included in the BHA 104) or at the surface 110 (FIG. 1). In some embodiments, for example, the communications module 214 itself may serve as the computerized system as described herein. When downhole operational parameter data surpass or otherwise breach one or more predetermined limits of operation, the computerized system may be configured to alert an operator or user to the operational anomaly and, in response, one or more corrective command signals may be sent to the BHA 104 in order to alter the downhole operational conditions to bring the operational parameters back into a safe or efficient operating range. As indicated above, the corrective command signal may trigger actuation or operation of one or both of the vibration subs 130*a,b*. In other embodiments, upon recognizing or otherwise determining a breach or surpassing of the predetermined limit of operation, the computerized system may be configured to automatically send the one or more corrective action signals to the BHA 104, without departing from the scope of the disclosure. Accordingly, the one or more corrective actions may be fully automated, in at least one embodiment.

As will be appreciated, the communication lines 216, 220 may be any type of wired or wireless telecommunications devices or means known to those skilled in the art such as, but not limited to, electric wires or lines, fiber optic lines, downhole telemetry techniques (mud pulse, acoustic, electromagnetic frequency, etc.), combinations thereof and the like. In some embodiments, the communications lines 216, 220 may form part of a wired drill pipe system, which uses electrical wires to transmit electrical signals to and from the surface.

Those skilled in the art will readily appreciate that drilling with both the drill bit 114 and the reamer 204 can significantly affect performance and thereby affect specific energy calculations. Due to different levels of aggressiveness in the drill bit 114 and the reamer 204, the side cutting force of each tool may result in different corresponding specific energies. For instance, as the BHA 104 advances within the subterranean formation 210, the drill bit 114 and the reamer 204 may drill different formations exhibiting entirely different formation strengths. As a result, each cutting tool may experience different amounts of stiction, bounce, and/or other unwanted displacements or vibrations, thereby requiring the vibration subs 130*a,b* to operate at different times, at different frequencies, in phase, and/or out of phase to generate desired vibrations that advantageously affect operation of the drill bit 114 and the reamer 204 in various scenarios.

For every rotation of the drill bit 114, there are a number of forcing function impulses, as may be specified by an excitation frequency factor. At a specific number of revolutions per minute (RPM), for instance, the forcing impulse occurs at the rate of (RPM×excitation frequency factor) per minute. A model for determining the vibration sub configurations may use an RPM value that is the RPM of the drill bit face relative to the formation being drilled because the drill bit RPM×excitation frequency factor is the forcing function frequency. The forcing function at the drill bit is a function of RPM, which is needed for the analysis.

When a drilling motor (or mud motor) is present in the BHA 104, the RPM value at the drill bit 114 must be the value of the drill string RPM and the drilling motor RPM value. These RPM values are used to calculate the frequency of impact of the drill bit 114 and the reamer 204 (i.e., hole opener) combination with the formation.

For example, a typical excitation used for modeling the dynamic effects of a roller cone bit with three cones is determined by providing a suitable load and displacement at the rate of three times per revolution. The displacement may be in the form of lateral, axial, or torsional motion, or in the form of some combination of the three. Although excitations occur primarily at the drill bit, additional excitation may come from downhole motors, stabilizer contact points, under reamers, and hole openers. A combination of a drill bit and a reamer, in addition to stabilizers, has been considered and analyzed with respect to the present disclosure. For each excitation function, regardless of whether or not it arises from the applied forces, the applied displacements consist of a magnitude and phase angle, and their respective locations along the drill string 106.

Experience indicates that the excitation factor from tri-cone bits or tri-cone hole openers is three. This value is expected as a result of the three-cone bit geometry and its response as it rolls over high and low spots in the formation. This type of excitation produces axial and torsional bit displacements with frequencies of three cycles per revolution because of the three cones. For PDC bits, the excitation factors are associated with blade patterns or cutter distributions. Higher factors represent complex behaviors, such as backward whirl.

The excitation frequency for a given drill string can be given as:

$$N = \frac{f \times 60}{EF} \text{ or } f = \frac{N \times EF}{60} \qquad \text{Equation (1)}$$

The relationship of the phase angle φ to the maximum amplitude of various parameters can be related by:

$$x(t) = x_m \cos(\omega t - \phi) \qquad \text{Equation (2)}$$

$$\Phi_{dj} = \tan^{-1}\left(\frac{u_{sj}}{u_{cj}}\right) \qquad \text{Equation (3)}$$

where x(t) is the quantity being measured (e.g., stress, force, displacement, or moment) as a function of time; $X_m$ is the maximum magnitude of the quantity being measured (e.g., stress, force, displacement, or moment); t is the time (sec); and j is the degree of freedom number.

The maximum positive x(t) (e.g., stress, force, displacement, or moment) occurs at:

$$(\omega t - \phi) = 0;\ \cos(0) = 1 \qquad \text{Equation (4)}$$

The maximum negative x(t) (e.g., stress, force, displacement, or moment) occurs at:

$$(\omega t - \phi) = \frac{\pi}{2};\ (\omega t - \phi) = \frac{\pi}{2} \qquad \text{Equation (5)}$$

Figure 3:
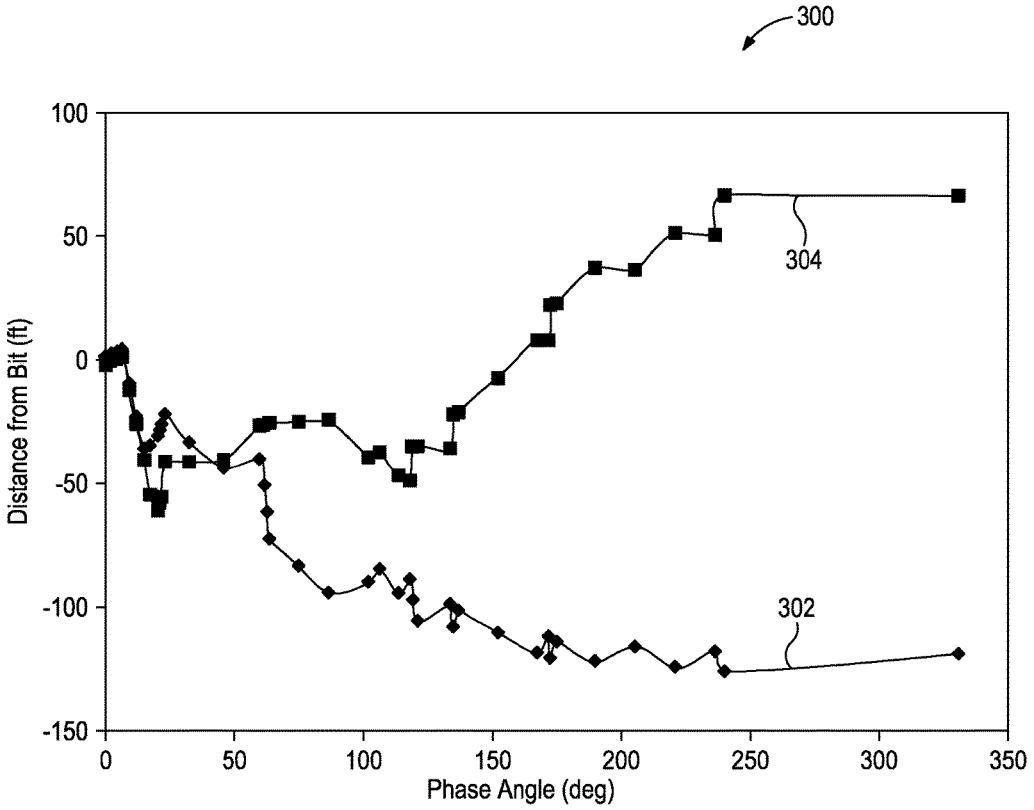
FIG. 3 is a graph showing the phase angle as a function of the distance from the drill bit and a hole opener in a drill string that can be used to determine the placement, number, and vibrational characteristics of vibration subs for a bottom-hole assembly.

FIG. 3 is a graph that shows how the phase angle changes as a function of the distance from the drill bit and the reamer (i.e., the hole opener). In particular, the graph shows two curves 302 and 304 corresponding to the phase angle as a function of distance from the drill bit and the reamer, respectively. The divergence of curves 302 and 304 show how the hole opener and bit are out of phase. As the separation takes place after the depth of the hole opener or undereamer the components are getting displaced out of phase and so the energy is high above the hole opener.

Adjusting and otherwise optimizing the placement, number, orientation, and frequencies of the vibration subs 130*a,b* (FIG. 2) can reduce the occurrence of stick-slip and/or other drilling anomalies, such as whirl effects and/or bit bounce at both the drill bit 114 and the reamer 204.

Figure 4:
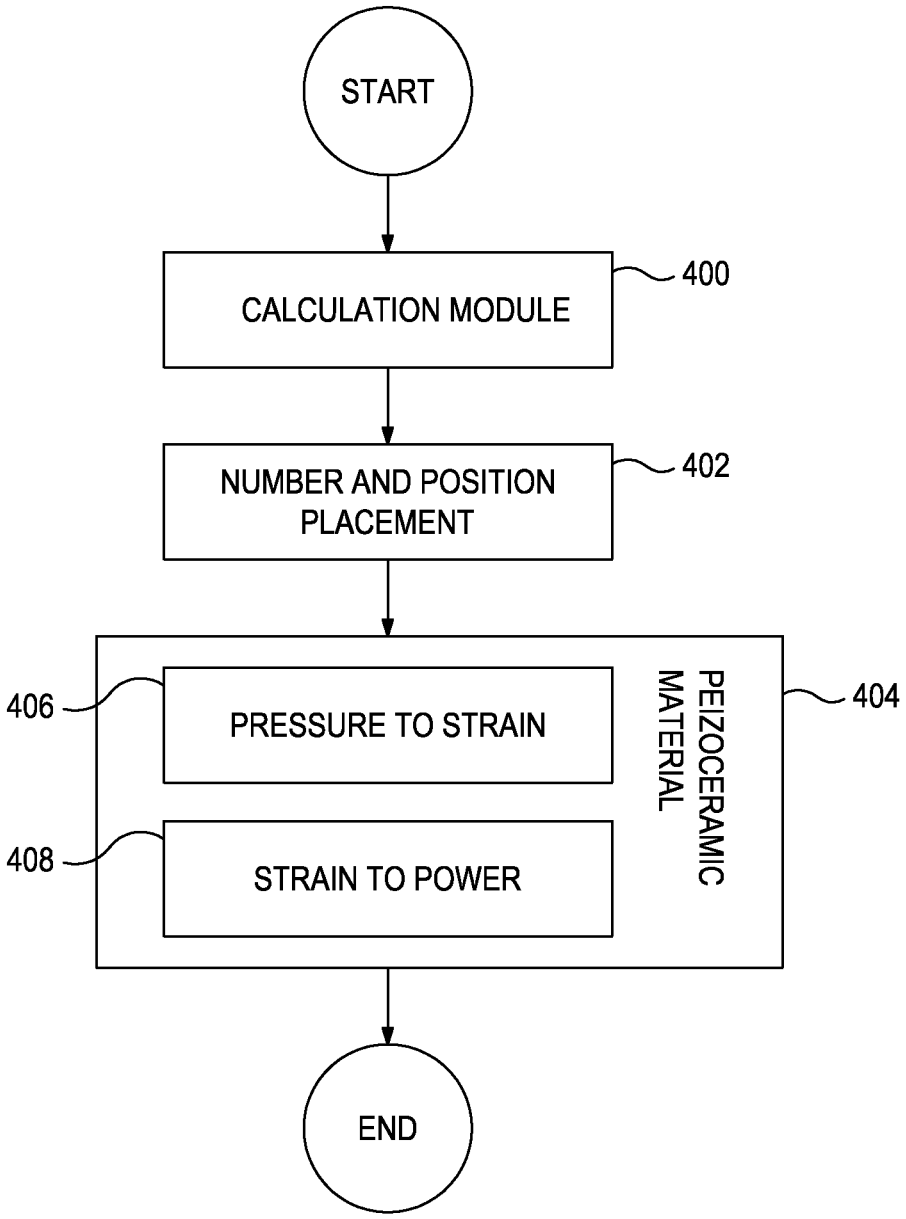
FIG. 4 is a schematic flowchart of a method for determining the placement, number, and vibrational characteristics of vibration subs for a bottom-hole assembly.

FIG. 4 is a schematic flowchart of a method determining the number, placement, orientation, and/or vibrational characteristics of one or more vibration subs in a BHA, according to one or more embodiments.

At block 400, a calculation module may be used to determine a physical model such as a model of a drill string including properties of a drill bit, a reamer, and/or other components of the drill string and based, for example, on knowledge or assumptions regarding a formation to be drilled may be generated.

At block 402, based on the model, a number of vibration subs and a position placement for the vibration subs may be determined. It may also be determined whether multiple vibration subs are to be operated in phase, out of phase, or an another relative phase.

At block 404, properties of vibratory devices of the vibration subs may be determined. In the example of FIG. 4, the pressure to strain 406 and the strain to power 408 properties of a piezoceramic material to be used in vibratory devices for the vibration subs may be determined. The vibration sub, based on the calculation of the separation phase angle, gets the strain and power. When there is a separation, the peizoceramic sub will be in action and thus reduce the stick slip and other vibration related problems.

In some embodiments, during drilling operations, additional adjustments to the operation of placed vibration subs and/or other vibratory devices in the drill string 106 may be adjusted in real time and based on sensor data gathered during drilling.

In some embodiments, multiple vibration subs 130, each including one or more integrated piezoceramic actuators operable to impart vibration, may be strategically placed along the BHA 104 so that they are in phase with one another. As will be appreciated, this may prove advantageous so that the strength of the resulting frequency signal derived from the vibration subs 130 is enhanced at one or more locations in the drill string 106. This may also prove advantageous in creating additional controlling frequencies that operate to reduce unwanted vibration at selected points along the BHA 104.

In other embodiments, multiple vibration subs 130, each including one or more integrated piezoceramic actuators operable to impart vibration, may be strategically placed along the BHA 104 so that they are out of phase with one another. As a result, the strength of the resulting signal may be cancelled out at one or more selected locations in the drill string 104. Again, this may also prove advantageous in creating additional controlling frequencies that operate to reduce unwanted vibration at select points along the BHA 104.

In various embodiments, self-contained vibration subs 130 may be provided in the drill string 106, and each vibration sub 130 may include a power supply, one or more vibratory devices, and a control system operable to control and otherwise regulate the vibratory devices. In some embodiments, vibratory devices may be disposed on or within other components besides vibration subs 130. For example, in one implementation of the BHA 104, as shown in FIG. 5, one or more vibratory devices, such as piezoceramic actuators, may be positioned on the drill bit 114, on one or more stabilizers 500, and/or on a tool string component, such as a rotary steerable system (RSS) tool 502.

Figure 5:
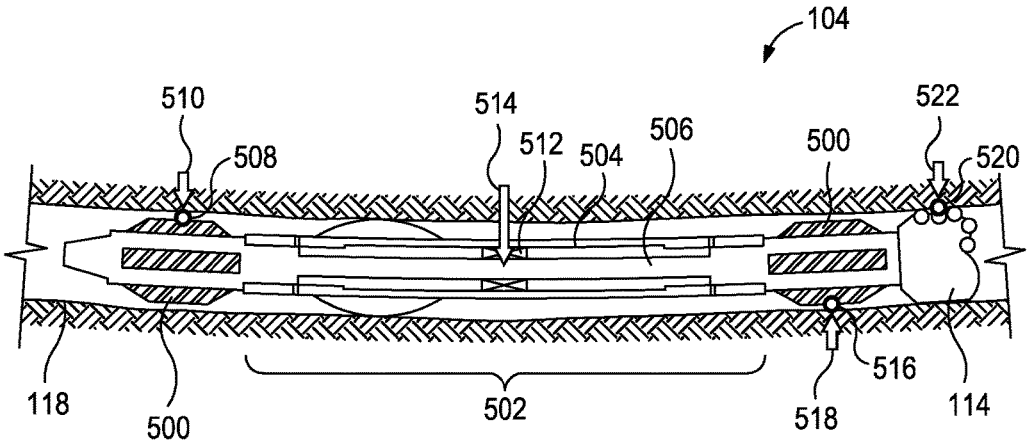
FIG. 5 is a cross-sectional view of an illustrative bottom-hole assembly having vibratory devices.

In the example of FIG. 5, a first vibratory device 508 is positioned at a first location 510 within or on a first stabilizer 500 on a first side of the tool string 502 and a second vibratory device 516 is positioned at a second location 518 within or on a second stabilizer 500 on an opposing second side of the tool string 502. As shown, one or more vibratory devices 512 may also be positioned at a third location 514 in the tool string 502. In such embodiments, the vibratory device(s) 512 may be operatively coupled to and configured to impart vibrations to a displaceable rotatable shaft 506 within a non-rotating body 504 of the RSS tool 502. For example, the vibratory device(s) 512 may be disposed adjacent to or proximate an actuator mechanism that displaces the rotatable shaft 506 and thereby helps control the drilling direction by manipulating the position of the face of the drill bit 114. However, this is merely illustrative. In other embodiments, one or more vibratory devices may be configured to impart vibrations directly to the tool body 504. As shown, in some embodiments, the drill bit 114 may be provided with a vibratory device 520 at a fourth location 522, where the vibratory device 522 imparts vibration directly to the drill bit 114.

Figure 6:
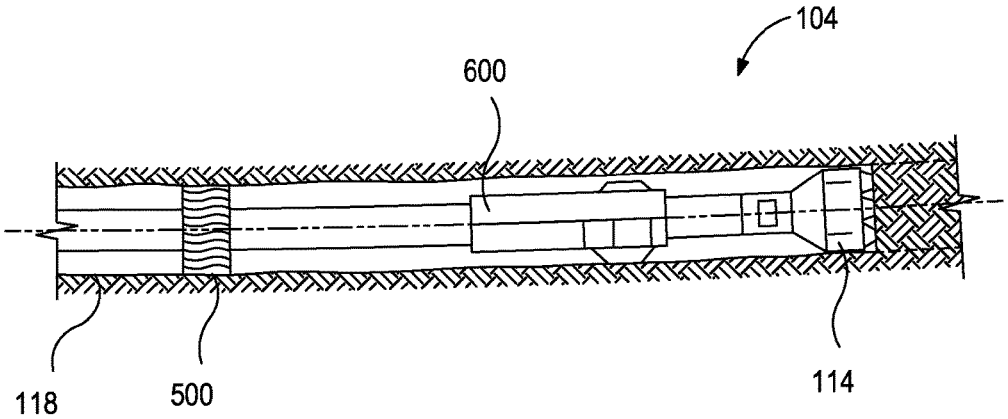
FIG. 6 is a side view of an illustrative bottom-hole assembly showing components that may include vibratory devices.

FIG. 6 shows another exemplary implementation of the BHA 104 having the stabilizer 500, the drill bit 114, and a non-rotating pad 600, each of which may include one or more integrated vibratory devices (not shown), such as piezoceramic actuators configured to impart vibration to the corresponding component of the drill string, according to one or more embodiments.

Figure 7:
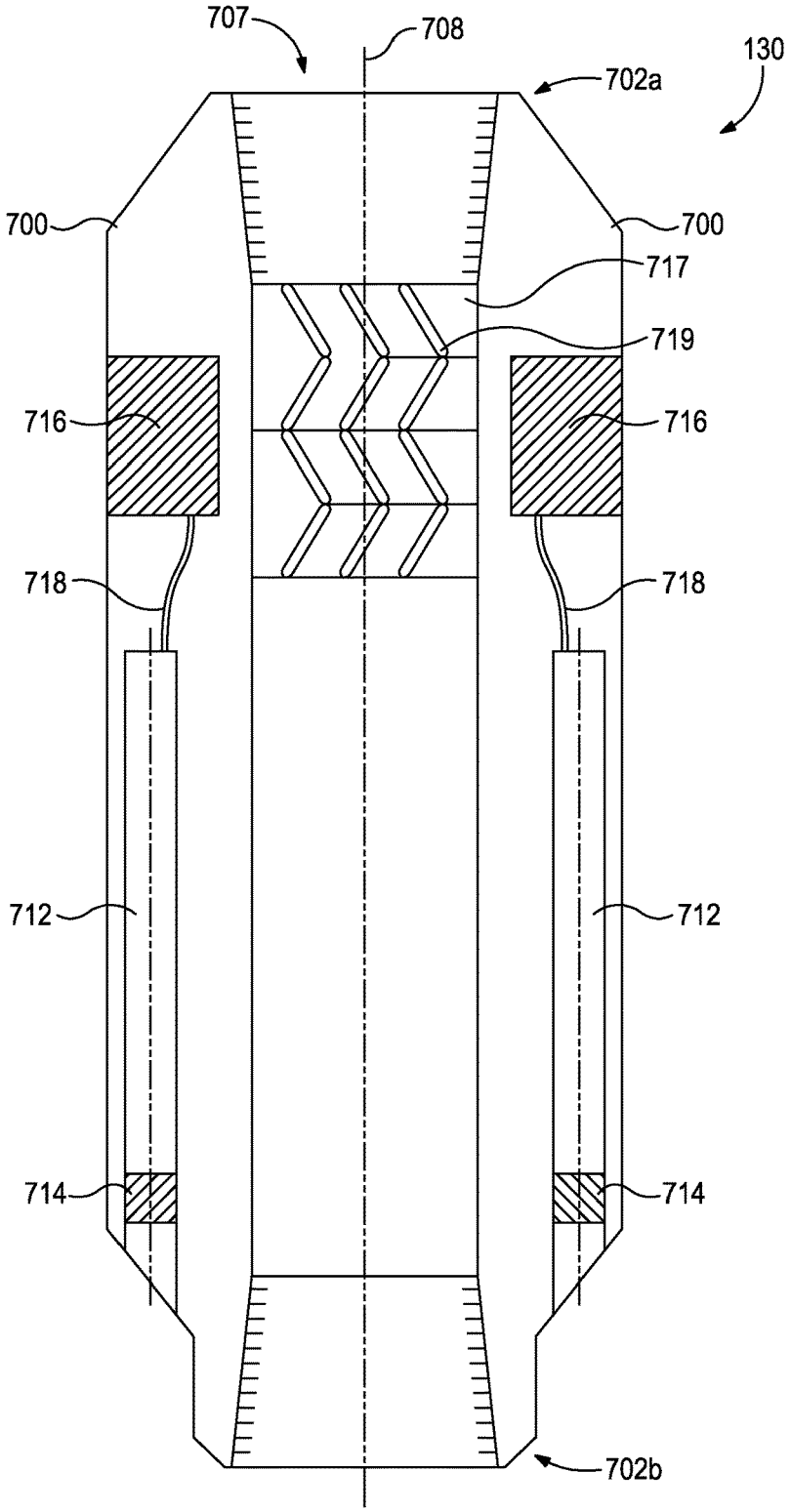
FIG. 7 is a cross-sectional view of an illustrative vibration sub having longitudinal or axial vibratory devices.

Referring to FIG. 7, depicted is an exemplary vibration sub 130 that may be used in accordance with the present disclosure. The vibration sub 130 may be the same as or similar to either of the vibration subs 130*a,b* of FIG. 2 and, therefore, may be configured to help mitigate or prevent stick-slip of cutting tools, such as the drill bit 114, the reamer 204, etc. positioned in the drill string 106 or otherwise forming part of the BHA 104.

The vibration sub 130 may be configured to impart or otherwise generate longitudinal vibration. As illustrated, the vibration sub 130 may include a tool body 700 that provides a first end 702*a* and a second end 702*b* opposite the first end. One or both of the first and second ends 702*a,b* may provide a threaded orifice used to couple the vibration sub to upper and/or lower portions of the BHA 104.

The vibration sub 130 may also include a power source 717. In some embodiments, the power source 717 may comprise an electrical generating module, such as a power generator. In some embodiments, as illustrated, the electrical generating module may comprise a turbine having one or more blades 719. Drilling fluid flowing through a bore 707 defined within the tool body 700 may impinge upon the blades 719, and thereby causing an associated rotor assembly of the turbine to rotate and generate electrical power. In other embodiments, the electrical generating module may comprise a Moineau motor generator, or other type of power generating device known to those skilled in the art. In yet other embodiments, the power source 717 may include one or more stored power modules, such as one or more batteries, fuel cells, or a power pack. Such stored power modules may be used as an alternative, or in addition to an electrical generating module. In at least one embodiment, one or more batteries may be provided as the power source 171 but supplemented and/or charged by a power generator, such as a turbine or a Moineau motor generator.

The power source 717 may be configured to provide electrical power to one or more vibratory devices 712 (e.g., piezoelectric modules) positioned within the tool body 700. In some embodiments, the electrical power may be delivered to the vibratory devices 712 through a sensor and control module 716 via one or more power cables 718. The sensor and control module 716 may be configured to monitor local vibrations or acceleration and, when the local vibrations/acceleration exceeds a specified or predetermined threshold, electrical power may be conveyed to the vibratory devices 712 from the power source 717 for operation. The sensor and control module 716 may be further configured to manage operation of the power source.

In some embodiments, the sensor and control module 716, the power cables 718, and/or the vibratory devices 712 may be communicatively coupled to each other with signal and control lines, such as the communication lines 216, 220 of FIG. 2.

In some embodiments, the vibratory devices 712 may comprise piezoceramic actuators. In operation, the vibratory devices 712 may be configured to create longitudinal motion that mitigates harmful BHA dynamics, such as whirl, stick-slip, and bit bounce. As illustrated in FIG. 7, the vibratory devices 712 may be oriented longitudinally in the tool body 700 and otherwise extending substantially parallel to the longitudinal axis 708. The vibratory devices 712 may be operationally coupled to the tool body 700 by seal and preload members 714 disposed between distal ends of each vibratory device 712 and the tool body 700. The seal and preload members 714 may be formed from rigid or partially compliant materials for sealing the vibratory devices 712 to the tool body 700 and for communicating longitudinal motion (e.g., longitudinally oriented vibrations or acceleration) to the tool body 700. As will be appreciated by one skilled in the art, the longitudinal vibrations imparted to the tool body 700 may, in turn, be assumed by other drill string components, such as a drill bit, a reamer, or other tools that may be operatively coupled to the vibration sub 130 via connection at the first and/or second ends 702*a,b*.

Figure 8:
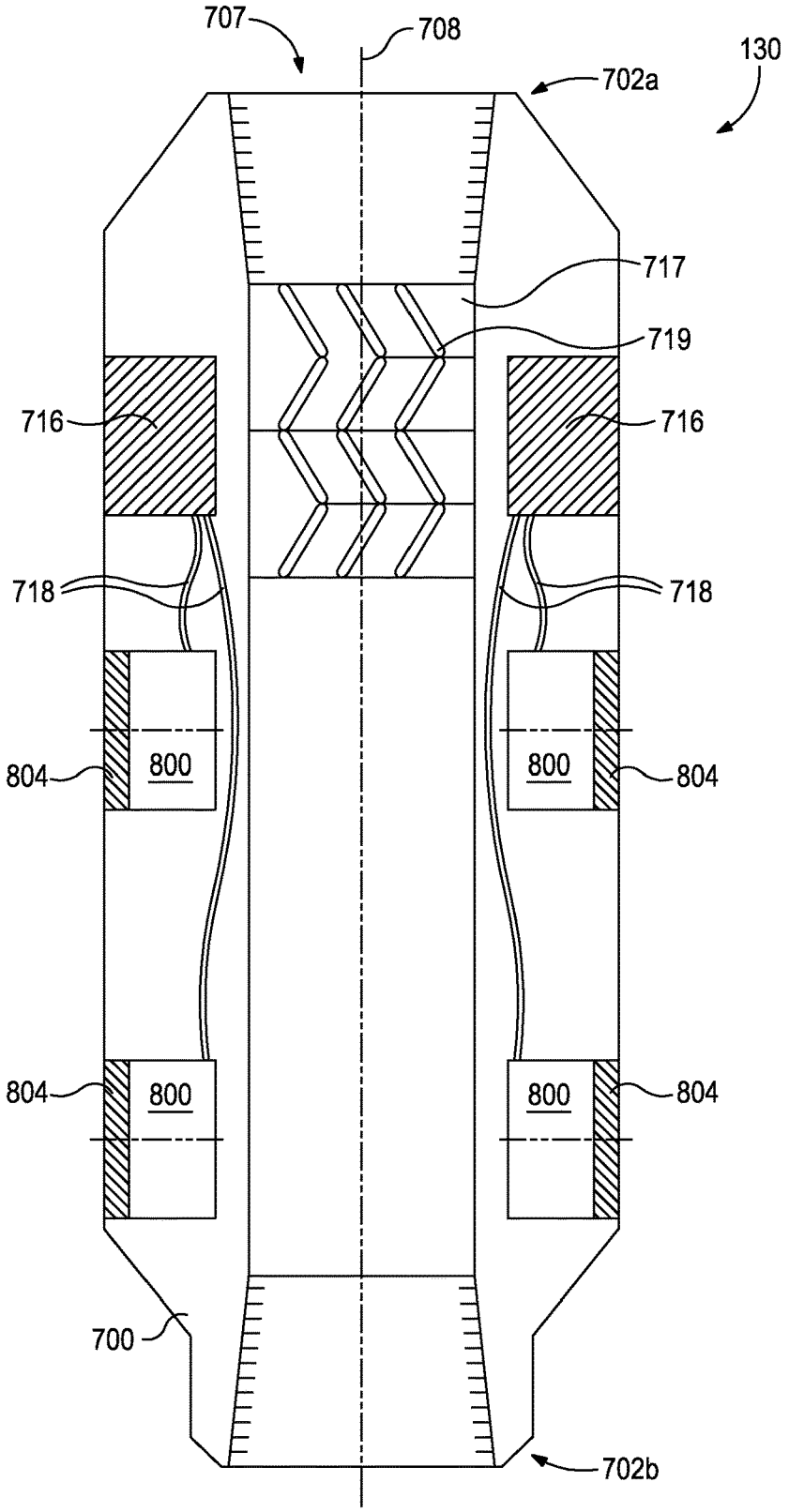
FIG. 8 is a cross-sectional view of an illustrative vibration sub having lateral or torsional vibratory devices.

In FIG. 8, another exemplary embodiment of the vibration sub 130 is depicted, in accordance with one or more embodiments. Reference numerals used in FIG. 7 that are used in FIG. 8 refer to similar components or elements that may not be described again. As illustrated in FIG. 8, the vibration sub 130 may be provided with one or more vibratory devices 800 (e.g., piezoelectric modules) that are oriented radially in the tool body 700. More particularly, the vibratory devices 800 may positioned such that they extend around some or all of a circumference of the tool body 700 in a direction substantially perpendicular to the longitudinal axis 708. The vibratory devices 800 may be operationally coupled to the tool body 700 by seal and preload members 804 disposed between each piezoelectric module 800 and the tool body 700. The seal and preload members 804 may be formed from rigid or partially compliant materials for sealing the vibratory devices 800 to the tool body 700 and for communicating lateral and/or torsional motion to the tool body 700. More specifically, the vibratory devices 800 may be configured to generate laterally oriented vibrations or acceleration that include motion substantially perpendicular to the tool body 700, or circumferentially oriented vibrations that include motion substantially tangential to the tool body 700. As will be appreciated by one skilled in the art, the lateral and/or torsional vibrations imparted to the tool body 700 may, in turn, be assumed by other drill string components, such as a drill bit, a reamer, or other tools that may be operatively coupled to the vibration sub 130 via connection at the first and/or second ends 702*a,b*.

As will be appreciated, the vibration subs 130 described herein can have one or a plurality of vibratory devices 712, 800, which may be arranged longitudinally, radially, or a combination of both within the same vibration sub 130, without departing from the scope of the disclosure. Accordingly, the vibration subs 130 described herein may be configured to selectively deliver vibrations in a preferred or predetermined direction and thereby interact with a borehole or wellbore. As a result, the vibration subs 130 may provide a programmable, dynamic response to BHA vibrations.

In one embodiment, one or more vibratory devices 712, 800 of a vibration sub 130 are oriented longitudinally in the tool body 700 for axial or longitudinal motion. In another embodiment, one or more vibratory devices 712, 800 of a vibration sub 130 are oriented radially in the tool body 700 for lateral motion or torsional motion. In yet another embodiment, one or more vibratory devices 712, 800 of a vibration sub 130 include at least two piezoelectric modules, in which a first piezoelectric module is oriented longitudinally in the tool body 700 and a second piezoelectric module is oriented radially in the tool body 700. In another embodiment, one or more vibratory devices 712, 800 of a vibration sub 130 include at least two piezoelectric modules, in which the at least two piezoelectric modules are oriented in at least two different directions. In another embodiment, the at least two piezoelectric modules are actuatable independently or in unison.

As discussed above with reference to FIG. 4, optimum placement of the vibration subs 130 can be determined based on a frequency analysis. More specifically, an applied load vector {p(t)} at time t can be determined using Equation (6) below:

$$\{p(t)\}=\{I(u,t)\}+[C]\{u'(t)\}+[M]\{u'(t)\} \quad \text{Equation (6)}$$

where {I(u,t)} is the internal force vector at time t and displacement state {u'(t)}; [C] is a damping matrix (consisting of a structural damping matrix and a fluid damping matrix); and [M] is a mass matrix.

The "phase angle" relates to the relative timing of forces and displacements in a dynamic realm. Because both are harmonic (i.e., a combination of sine and cosine functions), the period (frequency) and magnitude of both may be known, but the phase angle may be required to provide an indication as to how the two are functioning relative to one another. For example, when a force at the bit is at a maximum, it may prove useful to know what the magnitude of the displacement is at a stabilizer. They could occur at the same time (in phase or at a phase angle=0), they may occur at exactly opposite times in their individual cycles (out of phase or at a phase angle=180), they may occur or at any other phase angle.

Because of the assumption of "harmonic motion" imposed on the solution of the critical speed analysis (CSA) vibrational model (Apostal et al. 1990), the relationship of the phase angle to the maximum amplitude of the various parameters may be written as Equation (2) above. In Equation (2), again, x(t)=the quantity being measured (e.g., stress, force, displacement, or moment) as a function of time; and $x_m$=the maximum magnitude of the quantity being measured (e.g., stress, force, displacement, or moment). Moreover, ω is the string angular velocity (rad/sec) which is equal to $$x\frac{2\pi}{60}rpm;$$

t is the time (sec) because with the initial excitation impulse at the start of this rotation as ωt went from zero to 2π (rad), this would be one rotation; and φ is the phase angle (rad). Equations (4) and (5) above provide the maximum positive x(t) and the maximum negative x(t), respectively. An optimal number and placement of the vibration subs for reducing stick-slip, whirl, and/or bit bounce can be determined using the applied load vector above, in one or more embodiments.

Figure 9:
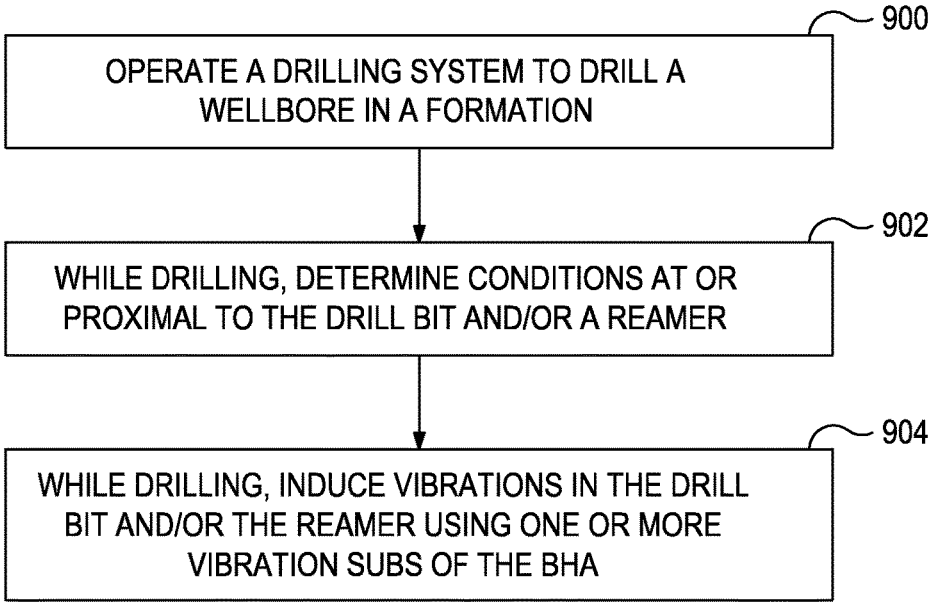
FIG. 9 is a schematic flow chart of a method for operating a drilling system having a bottom-hole assembly with vibratory devices.

FIG. 9 is a schematic flowchart of a method reducing stick-slip, whirl, bit bounce and/or other unwanted lateral, axial, or torsional motions while drilling, according to one or more embodiments. At block 900, a drilling system (e.g., the drilling system shown in FIGS. 1 and 2 having a drill bit 114, a reamer 204, and one or more vibratory devices and/or vibration subs 130) may be operated to drill a wellbore in a formation. At block 902, while drilling, conditions (e.g., vibrations, motions, displacements) at one or more locations in the drill string may be determined. For example, the conditions at or proximal to the drill bit and/or reamer may be determined. Determining the conditions may include gathering sensor data with a sensor assembly in a vibration sub or with a separate sensor assembly. Sensor data may include data indicating local vibrations occurring at the sensor.

At block 904, while drilling, vibrations may be induced in the drill bit and/or the reamer using one or more vibration subs of the BHA. For example, piezoelectric modules in a vibration sub may be generated based on (or independent of) the determined conditions. The generated vibrations may be transmitted from the vibration sub tool body (e.g., via a sealing and preload member) to the drill bit and/or the reamer. As discussed herein, inducing vibrations may include inducing vibrations at the drill bit using a vibration sub proximal the drill bit and/or inducing vibrations at the reamer using a vibration sub at the reamer. In some embodiments, inducing vibrations at block 904 may include inducing vibrations in a stabilizer, tool string, or other component of the drill string using vibratory devices on or within that component of the drill string as, for example, discussed above in connection with FIGS. 5 and 6.

Although the examples discussed herein have been described in the context of drill bit drilling applications, also contemplated herein are non-drill bit drilling applications, such as thermal, laser, or jetting applications. In such cases, the vibration subs may prove advantageous since the remaining portions of the BHA can cause stick-slip without a bit in contact with the bottom of the hole. For instance, in at least one embodiment, the presently described vibration subs may be selectively actuated while running drill string to depth, but prior to drilling operations. In such embodiments, the vibration subs may prove advantageous in preventing stiction against the inner walls of casing or the wellbore during run-in.

Moreover, the vibratory devices and/or the presently described vibration subs may alternatively be employed in a variety of non-drilling downhole operations. Such operations include, but are not limited to, running casing or liner to depth, fracturing operations, cementing operations, and other completion operations. In such embodiments, the presently described vibration subs may form part of a tool string and may be run downhole simultaneously with other tools and equipment used for non-drilling operations. For example, one or more vibration subs may be included and selectively actuated while running casing or liner into a wellbore in preparation for a completion or cementing operation.

Embodiments disclosed herein include:

A. A bottom-hole assembly that includes a drill string extendable within a wellbore, a drill bit positioned at a distal end of the drill string, and a vibration sub positioned in the drill string axially adjacent the drill bit and including one or more vibratory devices that impart vibration to the drill bit.

B. A vibration sub that includes a tool body able to be coupled to a bottom-hole assembly, a power source positioned within the tool body, one or more vibratory devices positioned within the tool body and powered by the power source to impart vibration to the bottom-hole assembly.

C. A method that includes introducing a drill string into a wellbore, the drill string including a drill bit positioned at a distal end of the drill string and a vibration sub positioned axially adjacent the drill bit and including one or more vibratory devices, and actuating the one or more vibratory devices to impart vibration to the drill bit and thereby mitigate an occurrence of at least one of stick-slip and drill string whirl.

Each of embodiments A, B, and C may have one or more of the following additional elements in any combination: Element 1: wherein the one or more vibratory devices comprise one or more piezoelectric modules. Element 2: wherein the one or more piezoelectric modules comprise piezoceramic actuators. Element 3: wherein a frequency of the vibration is between 0.001 Hz and 500 Hz. Element 4: wherein the vibration sub is a first vibration sub, the bottom-hole assembly further comprising a reamer positioned in the drill string and axially offset from the drill bit, and a second vibration sub positioned in the drill string axially adjacent the reamer and including one or more additional vibratory devices that impart vibration to the reamer. Element 5: wherein the first vibration sub vibrates in phase with the second vibration sub. Element 6: wherein the first vibration sub vibrates out of phase with the second vibration sub.

Element 7: wherein the power source comprises a power generator selected from the group consisting of a turbine and a Moineau motor generator. Element 8: wherein the power source comprises one or more batteries or fuel cells. Element 9: further comprising a sensor and control module communicably coupled to the power source for delivering electrical power to the one or more vibratory devices. Element 10: wherein the one or more vibratory devices comprise piezoelectric modules having piezoceramic actuators. Element 11: wherein the one or more vibratory devices are oriented longitudinally in the tool body for axial or longitudinal motion. Element 12: wherein the one or more vibratory devices are oriented radially in the tool body for lateral motion or torsional motion. Element 13: wherein the one or more vibratory devices comprise at least two piezoelectric modules, wherein a first piezoelectric module is oriented longitudinally in the tool body and a second piezoelectric module is oriented radially in the tool body.

Element 14: further comprising sensing local vibrations with a sensor and control module of the vibration sub, and sending electrical power to the vibratory devices when the local vibrations exceed a predetermined threshold. Element 15: wherein sending the electrical power to the vibratory devices comprises managing operation of a power source of the vibration sub. Element 16: wherein managing operation of the power source comprises supplementing or charging a battery of the vibration sub with a power generator selected from the group consisting of a turbine and a Moineau motor generator. Element 17: wherein the one or more vibratory devices comprise at least two piezoelectric modules, wherein at the at least two piezoelectric modules are oriented in at least two different directions, and wherein actuating the one or more vibratory devices comprises actuating the at least two piezoelectric modules in the at least two different directions. Element 18: wherein actuating the at least two piezoelectric modules comprises actuating the at least two piezoelectric modules independently or in unison. Element 19: wherein actuating the one or more vibratory devices comprises generating axial or longitudinal motion using vibratory devices oriented longitudinally in the tool body. Element 20: wherein actuating the one or more vibratory devices comprises generating lateral motion or torsional motion using vibratory devices oriented radially in the tool body. Element 21: further comprising actuating the one or more vibratory devices while running the drill string into the wellbore and prior to drilling.

By way of non-limiting example, exemplary combinations applicable to A, B, and C include: Element 1 with Element 2; Element 4 with Element 5; Element 4 with Element 6; Element 14 with Element 15; Element 15 with Element 16; and Element 17 with Element 18.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A bottom-hole assembly, comprising:

a drill string extendable within a wellbore;

a drill bit positioned at a distal end of the drill string;

a reamer positioned in the drill string and axially offset from the drill bit;

a first vibration sub positioned in the drill string axially adjacent the drill bit and including one or more vibratory devices that impart vibration to the drill bit; and a second vibration sub positioned in the drill string axially adjacent to the reamer and including one or more additional vibratory devices that impart vibration to the reamer.

2. The bottom-hole assembly of claim 1, wherein the one or more vibratory devices comprise one or more piezoelectric modules.

3. The bottom-hole assembly of claim 2, wherein the one or more piezoelectric modules comprise piezoceramic actuators.

4. The bottom-hole assembly of claim 1, wherein a frequency of the vibration is between 0.001 Hz and 500 Hz.

5. The bottom-hole assembly of claim 1, wherein the first vibration sub vibrates in phase with the second vibration sub.

6. The bottom-hole assembly of claim 1, wherein the first vibration sub vibrates out of phase with the second vibration sub.

7. A method, comprising:

introducing a drill string into a wellbore, the drill string including a drill bit positioned at a distal end of the drill string, a reamer positioned in the drill string and axially offset from the drill bit, a first vibration sub positioned axially adjacent the drill bit and including one or more vibratory devices, and a second vibration sub positioned in the drill string axially adjacent to the reamerand including one or more additional vibratory devices;

actuating the one or more vibratory devices of the first vibration sub to impart vibration to the drill bit and thereby mitigate an occurrence of at least one of stick-slip and drill string whirl; and actuating the one or more vibratory devices of the second vibration sub to impart vibration to the reamer.

8. The method of claim 7, further comprising:

sensing local vibrations with a sensor and control module of the first vibration sub; and sending electrical power to the vibratory devices when the local vibrations exceed a predetermined threshold.

9. The method of claim 8, wherein sending the electrical power to the vibratory devices comprises managing operation of a power source of the first vibration sub.

10. The method of claim 9, wherein managing operation of the power source comprises supplementing or charging a battery of the first vibration sub with a power generator selected from the group consisting of a turbine and a Moineau motor generator.

11. The method of claim 7, wherein the one or more vibratory devices comprise at least two piezoelectric modules, wherein at the at least two piezoelectric modules are oriented in at least two different directions, and wherein actuating the one or more vibratory devices comprises actuating the at least two piezoelectric modules in the at least two different directions.

12. The method of claim 11, wherein actuating the at least two piezoelectric modules comprises actuating the at least two piezoelectric modules independently or in unison.

13. The method of claim 7, wherein actuating the one or more vibratory devices comprises generating axial or longitudinal motion using vibratory devices oriented longitudinally in the tool body.

14. The method of claim 7, wherein actuating the one or more vibratory devices comprises generating lateral motion or torsional motion using vibratory devices oriented radially in the tool body.

15. The method of claim 7, further comprising actuating the one or more vibratory devices while running the drill string into the wellbore and prior to drilling.

* * * * *